United States Patent [19]

Stephens

[11] Patent Number: 4,478,601

[45] Date of Patent: Oct. 23, 1984

[54] COAL BRIQUETTE AND METHOD

[76] Inventor: Leonard Stephens, R.D. #1, Box 671, McClellandtown, Pa. 15458

[21] Appl. No.: 456,107

[22] Filed: Jan. 6, 1983

Related U.S. Application Data

[63] Continuation-in-part of Ser. No. 229,977, Jan. 30, 1981, abandoned.

[51] Int. Cl.[3] ..... C10L 5/36; C10L 5/32

[52] U.S. Cl. ..... 44/14; 44/6; 44/15 D; 44/15 E; 44/38

[58] Field of Search ..... 44/15 A, 15 D, 15 R, 44/16 C, 14, 20, 38, 16 E, 6

[56] References Cited

U.S. PATENT DOCUMENTS

| | | | |
|---|---|---|---|
| 428 | 2/1879 | Wise | 44/15 D |
| 2,822,251 | 12/1958 | Swinehart et al. | 44/41 |
| 3,829,297 | 8/1974 | Crawford | 44/15 D |

FOREIGN PATENT DOCUMENTS

| | | | |
|---|---|---|---|
| 47-21222 | 6/1972 | Japan | 44/15 D |
| 13637 | of 1887 | United Kingdom | 44/15 D |

*Primary Examiner*—Carl F. Dees
*Attorney, Agent, or Firm*—Fay & Sharpe

[57] ABSTRACT

A fuel block containing concentrated combustibles is provided in a stackable, clean package which is readily ignited, and after an initial ignition burn, is consumed from the inside out with minimal smoke release. In the preferred form of the invention, ends and sides of the block have parallel faces, but the base is concave to permit an air entry passageway when the block is so positioned and burned on any generally flat surface. The top or opposite face is congruently convex to the bottom face permitting stacking of individual blocks both in storage and use. When stacked in combustion use, interior air passages or flues both horizontal and vertical, through the exterior faces of the individual block align to provide a "coking" action, as is also the case when burning of an individual block alone.

The block is formed principally from coal mine particulates, coke particulates, etc., by a section defining extrusion of the plastic mix from partially dehydrated coal or coke particles most of which are not greater than about 1" nor less than about 100 mesh containing minor proportions of macro clumps of fibrous wicking material, a liquid hydrocarbon distillation fraction and methyl cellulose. The section of the extruded mass may be of any geometrical form, but the preferred form is in accordance with the accompanying drawings.

17 Claims, 7 Drawing Figures

COAL BRIQUETTE AND METHOD

THE INVENTION

This invention is directed to a readily stackable, easily ignited fuel block which is extruded from a water-containing stiff plastic mix of coal and/or coke particles from water soluble celluloses and mine wastes or non-specification screen sizes of these premium fuels. The exterior surfaces of the so extruded block are wrapped in a combustible wrapper for easy handling and ignition. When available, it is preferred to carry into the stiff extrudable blocks formed packets of fibrous capillary wastes which carry in the interstices thereof liquified or readily liquified hydrocarbon distillates which aid ignition of the completed fuel block at low temperatures. The block is extruded with at least one longitudinal air conduit or passageway throughout the block length. A plural number of vertical chimneys or passageways are subsequently extruded or drilled at right angles at the longitudinal conduit and are preferably connecting therewith. These air passageways interiorly of the block provide controlled burning rates of the block so that combustion of the heating unit is from the interior outwardly, leading to optimum heat output over a predetermined time frame. These air flues are introduced during initial forming and shaping of the unit and prior to final wrapping.

Heterogeniously dispersed in the extrudable coal particle matrix are small packed clumps of fibrous organic wicking material which sorb and hold by capillary forces at least in part appreciable quantities of readily combustible hydrocarbon distillates either liquid or liquify at less than the boiling point of water. These packets of fibrous organic wicking material serve a plural number of uses as will be treated of more extensively below.

Use of colored flame producing salts are not precluded when a decorative, festive use warrants the added cost.

The invention may be more particularly described as a combustible high energy fuel block comprising (a) a major amount of water-wetted particulate hydrocarbon fuel; (b) said fuel characterized by a BTU content of in excess of about $10^4$ BTU/lb ; (c) said particulates not appreciably larger than about one inch, but principally retained on a 100 mesh screen; (d) interstitially dispersed among said fuel particulates a minor amount of macro clumps of capillary spaced apart combustible natural and/or synthetic fibers; (e) said packed clumps of fibers wetted by and holding by inherent capillary forces; (f) a quantity, but less than 25% by weight, of said particulate fuel of a fluent hydrocarbon distillate having a flash point above about 80° F.; (g) an amount, but not essentially more than about 5% by weight, of said fuel particulates of a water soluble alkyl cellulose to provide a viscous adhesive binder phase for said water-wetted fuel particulates; (h) said admixed mass compressed under pressures sufficient to compress said admixture into a self-supporting geometric form having; (i) air passageways through said block; (j) the interior surface area of said air passageways having a ratio of unit area thereof to the total fuel block unit volume of not less than about 1:2 and not more than about 6:5; (k) the exterior surfaces of said geometric form substantially overcoated with a combustible coating having a melting point above about 100° F., but less than about 225° F.

The block is longitudinally extruded from a plastic matrix (preferably characterized by four planar faces and two non-planar faces) at normal ambient room temperatures but relatively high pressures.

BACKGROUND OF THE INVENTION

In the original mining of coal, mountains of coal fines are developed from the operation and after separation are often submerged in water and in open pits as refuse, gob, or tailings. In general, before the "energy crunch" little effort had been made to recover the energy available in such coal mine tailings for costs of recovery in useful form were not economically promising. Of course, newly mined coal can be crushed to useful size as well, and coke particles are not precluded.

Heretofore solid blocks and "logs" of processed coal have been prepared in compressed package form utilizing various qualities of binders, primarily waste tars, bitumens, etc., by compression under high pressures into a form. So far as presently known, the continuous extrusion of wet coal (5–20% moisture level) with a water soluble binder has not been reduced to commercial practice. Forming useful "logs" or "blocks" of particulate coal by "water wetted" extrusion has not heretofor been known to be commercially successful.

Heretofore solid blocks and "logs" of processed coal in packaged form have been made available, but because of the quantities of water essentially present for mixing and forming, the formed blocks required a subsequent drying operation which itself required considerable energy input.

Further, in producing the coal mixtures a variety of binders have been used. In general organic solvent soluble binders failed to "wet" the coal particles and high temperatures and pressures were resorted to in individual molding operations to produce briquetted coal-particle integration. One patentee refers, for example, to pressures of from 50—800 atmospheres. Another used butadiene acrylonitrile polymers to bind the blocks at temperatures of about 230° C.

Schultz, U.S. Pat. No. 2,531,828 illustrates vertical and horizontal bores through fuel blocks which are sealed over with an impervious (paper) coating. Schultz provides no air and flame passageway through the base of his block or a capacity to use plural blocks in a nesting arrangement to obtain a coke forming effect during combustion.

So far as applicants are aware, the prior art also does not provide an extrudable coal, water-binder, solvent mixture which cohesively holds together at room temperatures and extruding pressures. The present invention provides an extruded product which has sufficient integrity to maintain its geometric, cross-sectioned regularity to permit both longitudinal and vertical drilling, slotting, cutting, and forming operations upon the freshly extruded coal mixture without a prior intermediate drying step.

It is a principal objective of this invention to provide a first plastic extrudable mixture, the major proportion by weight thereof being a partially dried or inspissated coal particle of about 10 to about 100 screen mesh size and where the water has been largely removed by both mechanical and evaporation removal steps. The divided coal and coal-derived particles are thoroughly mixed with minor proportions of additives thereto. The essential additives to the water wetted coal include an appreciable amount of a macroscopic particulate mass of finely divided combustible organic waste material which may originate from both natural and synthetic sources. A common characteristic of these organic wastes is their fibrous nature. Principally illustrative of those of natural origin are shredded waste paper and agricultural by-products illustrated by the cellulosic fiber wastes, i.e. "straw" and the heavier stalks, illustratively from corn and sugar cane (bagasse).

The synthetic fibers include as illustrative the polymeric fibers of polyolefins which because of their fine capillary thread-like quality and preferentially oil-wetted surfaces retain a relatively large quantity of lipophilic material, such as the common liquid hydrocarbon distillates commonly used for fuel purposes in the natural capillaries formed from macroscopic clumps or packets of the said fibers in close proximity to one another.

The foregoing are employed to retain and hold a companion ingredient; namely, a combustible (liquid) hydrocarbon fraction within these capillary fibrous masses.

A further essential additive is a selected methyl cellulose product which serves to take up extraneous water present in the major particulate coal particle component. While the amount of the water-soluble methyl cellulose is not critical, the quality of the water soluble alkyl cellulose has been found to be critical to the success or failure of the solid fuel particle extrusion step. The quality of the methyl cellulose in the Examples shown herein has been found to be extremely useful, whereas a number of other qualities, the nature of which is not available in sufficient detail to be able to define by known physical and chemical properties, can be the source of many problems in the mechanical act of producing successful particulate coal and coke extrusions as are herein disclosed.

When appropriate grades of methyl cellulose are used in the quantities indicated in the Examples, fuel particle extrusions can be produced at room temperatures to produce a longitudinal extrudate in a pre-formed geometrical dimensional mass which can be cut, drilled and/or slotted to produce the essential flues without losing the integrity of the extruded geometric form.

The entire block after completion of the air passageways by cutting, drilling, slotting or extrusion is preferably dipped in a liquid hydrocarbon distillate thereby to sorb the more volatile solvent to aid initial ignition. Thereafter, the block is substantially over-coated with a molten combustible coating having a melting point above about 100° F. but less than about 225° F., preferably a mineral wax.

DETAILED DESCRIPTION

There are two related aspects of the present invention, a first aspect having to do with the preferred physical form and make-up of the fuel block which permits initial burning of liberated gases with coking, and the second which makes possible extrusion of a physical-chemical admixture which conserves energy by use of coal and coal-derived particulates. Said particulates fuel is characterized by a BTU content of in excess of about $10^4$ BTU/lb.

While the particle size range of the fuel is not appreciably larger than about one inch, but principally retained on a 100 mesh screen, there are obviously a great diversity of particle sizes present to afford a relatively dense compactable mixture of particles throughout the range as is usual in slack coal for illustration.

Such compositions make extrusions and mechanical working of the extrusion mass practicable to produce a composition whose properties and geometric design in combustion lead to a "coking" operation, greater heat of combustion of the high energy containing fuel unit, and with little smoke and hydrocarbon loss. In other words, more controlled heat development and heat dissipation from the burning or rapid oxidation is provided.

First concerning the physical form of the invention, attention is directed to the drawings, in which.

Figure 1:
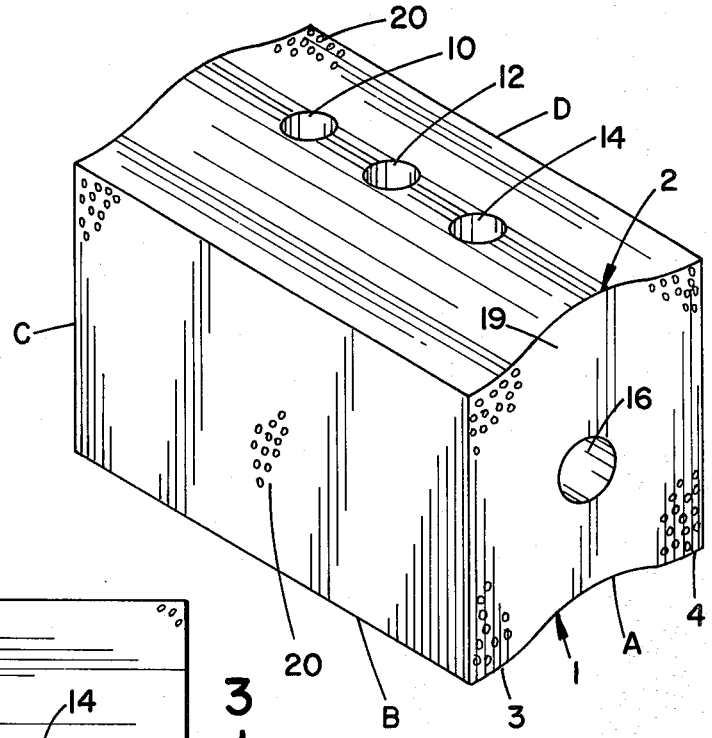
FIG. 1 is an isometric view of the completed, extruded block.

Referring to the drawings, the four block faces A, B, C, and D are planar, and end A and C, and sides sides B and D are parallel to one another, with the latter being rectangular.

Figure 2:
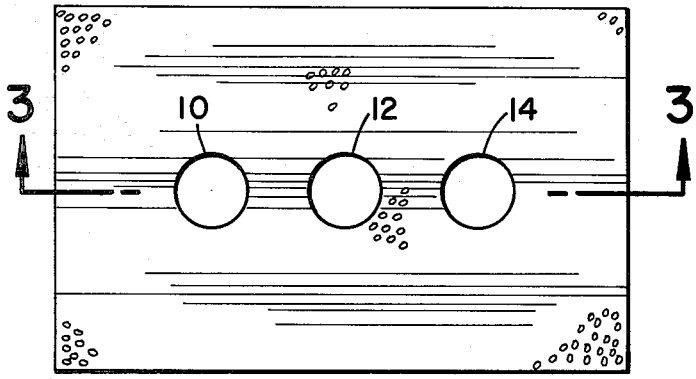
FIG. 2 is a top view of FIG. 1.
Figure 4:
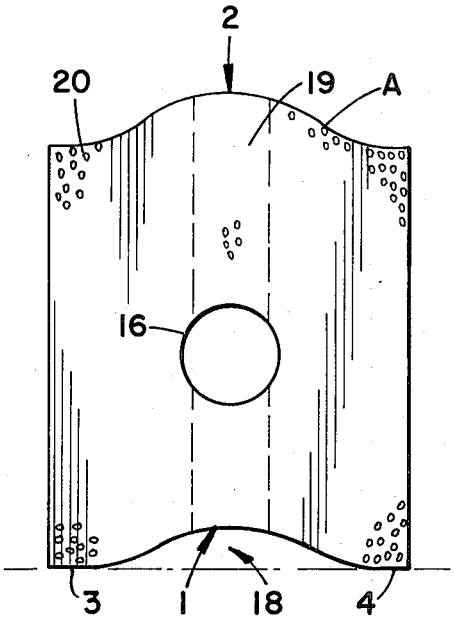
FIG. 4 is an end view.

The particular form of ends A and C are of importance to the sought for "coking" quality of the fuel blocks, either when burned as a single unit or where stacked in a plural number for burning. Note the concave face of top 2 and when a first unit block as in FIG. 1 is placed base down on a flat surface as seen in FIG. 2, opposing legs 3 and 4 provide relative massive support for the block and define an arcuate air passageway which endures for most of the burning period without collapse or loss of the arcuate section air passage 18, centrally beneath the block (as in FIG. 4).

Figure 5:
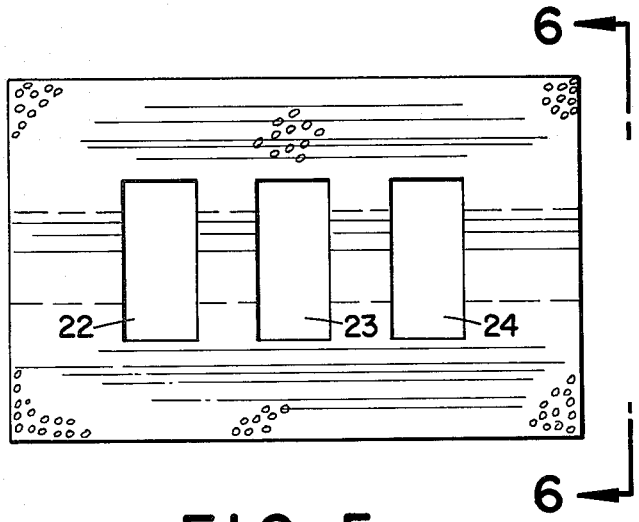
FIG. 5 is a top view of an alternative slot design of FIG. 1 showing extruded vertical slots of rectangular configuration.
Figure 6:
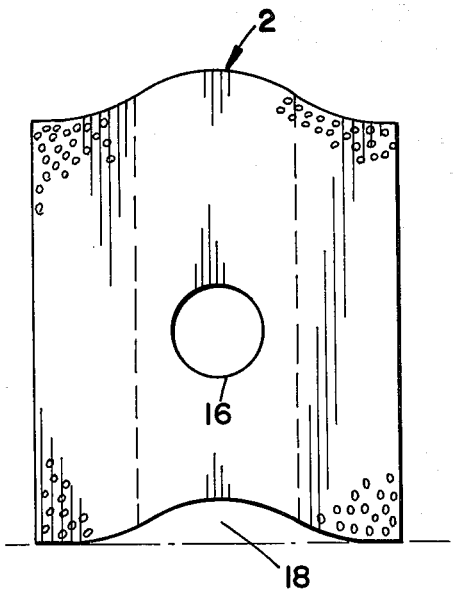
FIG. 6 is an end view through 6—6 of FIG. 5.

A plurality of vertical holes or slots 10, 12, and 14 in FIG. 1, 2, 3, and 4, and 22, 23, and 24 in FIG. 5 illustrate preferred air passageway modification. The geometric form of these air passageways interior of the block are not found to be of a critical nature. While it has been found desirable in controlling the rate of BTU release during combustion of the block to provide vertical chimney-like air passageways as above intersecting with horizontal exterior passageways, as illustrated by the base arcuate air section passage 18, it is not essential except for reproduction of FIG. 7 details that the vertical and horizontal air passageways 10, 12, 14, 23 and 24 intersect and connect with the horizontal passageways as illustrated in 16 and 25.

However, experience has indicated more rapid BTU release is thereby made possible and controlled rates of heat development through burning of the blocks.

When burning a single block unit the convex solid section forming the top face 2 enhances the chimney effect of the vertical chimney of holes 10, 12, and 14.

Shortly after ignition of volatile hydrocarbons externally of the block, the air passage encourages and promotes combustion of the volatiles present initially and the smoke is rapidly reduced in volume. Ignition interiorly of the vertical passageways in the presence of the excess of oxygen rich air soon provides an interior ignition surface for gases distilling from the block into said vertical passageways as the coal, coke, and capillary clumped particulates present are converted to coke-like solid fuel supply.

After all the vapors liberated by the coking process are consumed, principally interiorly of the block in the vertical drilled and horizontal extruded passageways 10, 12, 14 and 16, the porous coked block continues to burn until essentially all of the combustibles remaining of the block are consumed or otherwise released. After completion of the coking portion of the burn period, the porous mass allows access of oxygen rich air to flow into the block and through the pores thus created to provide a relatively smokeless evolution of heat.

The length of time of burn, or life of the block being consumed by fire, can be modified. Illustratively, in an extruded block of about 8" long×6" high×5" wide, from two to five vertical holes of about 1" in diameter (or a die cut slot) have been used. Four 1" holes or an equivalent slot in a block of this size is useful. Use of more chimney volume will cause faster combustion and shorter burning life of the fuel block in stove tests.

Figure 7:
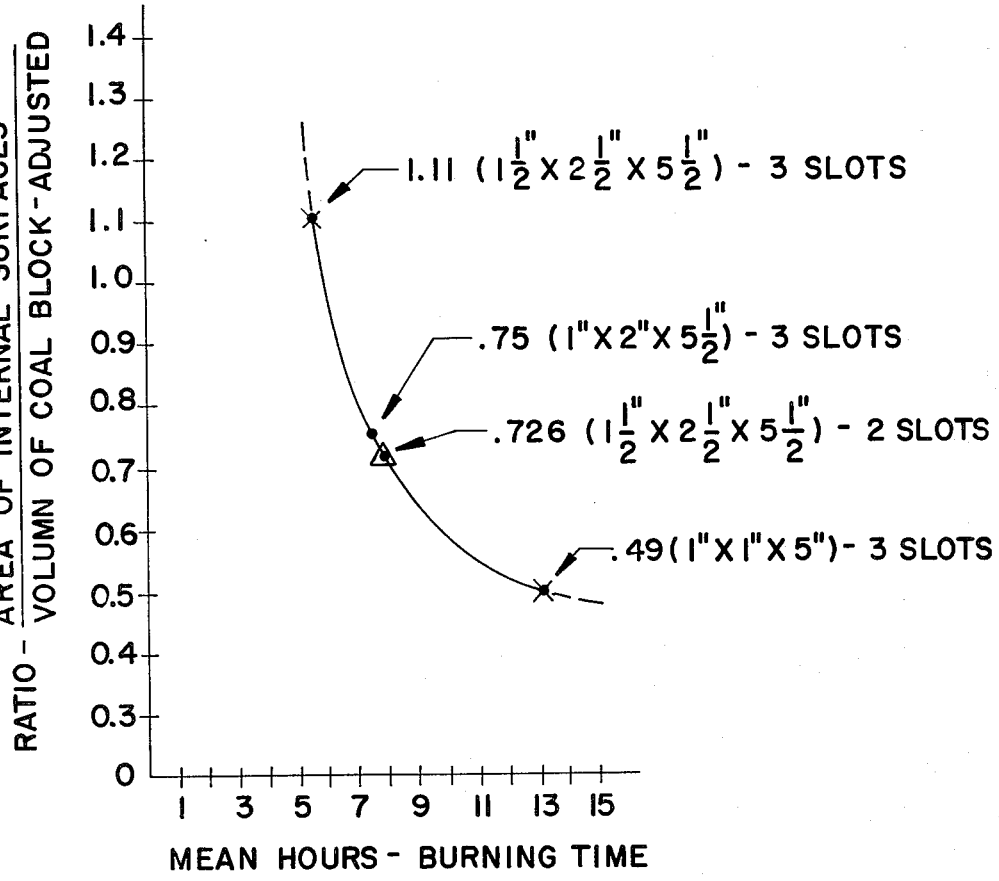
FIG. 7 is a graph illustrating the mean hours burning time of standard blocks of 5½" high, 4¾" wide and 8" long having a gross volume of 209 cubic inches plotted against the internal areas of the air passageways divided by the corrected volumes of fuel remaining in the standard block.

Referring particularly to FIG. 7 the importance of the size, geometry, and internal surface area of the air passageways and their number have been more fully investigated. To illustrate, at least in part, the nature of the relative size, shape, and construction of the block as are more fully developed in the following provides the basis for the preferred practice of the invention.

Four standard blocks were extruded having the standard exterior dimensions as generally shown above. Slots were provided as illustrated in FIG. 1 (longest burn time, 13–14 hours). Another has an intermediate burn time (as shown in FIG. 5). The third block also has the general geometry of FIG. 5, but this block employs rectangular slots of increased internal volume and consequently increased internal surface area.

In each of the three above experimental blocks, (made in accordance with the disclosure) the volumes of the slots or air passageways in each instance were calculated, the number of slots used as a multiplier and the total volume of fuel removed thereby adjustably subtracted from the theoretical total block fuel volume. In a similar manner the area internally of the block thereby created was also calculated. A ratio of the area of the internal surface (sq. inches) was divided by the actual remaining fuel volume (cubic inches) in the block. Each of the replicate blocks was burned under the same general conditions of draft in a controlled space environment. The mean hours of burn time was recorded, resulting in the general plot of FIG. 7.

All of the four test blocks are deemed to be useful and within the scope of the invention broadly. However, the block having the ratio of 1.1 has a desired burn period, but it was found to be too fragile to withstand rough handling in shipment tests.

The other extreme, the block having a ratio of 0.5, was very strong, but the time of burn as a single unit is over a time period which reduces the heat output BTU's per unit of time unless a plurality of blocks are burned in stacked arrays. It is, however, operable for general purposes of the invention and within the scope of the invention claimed.

Attention is directed to the blocks having a ratio of internal surface area of the flues or air passageways to adjusted fuel volume of 0.75 (3 slots) and 0.726 (2 slots), resulting in average burning times of 7–8 hours. These blocks are durable, strong, liberate their heat content at a desired rate level, and are ideally suited for the generally intended end purposes of the invention.

A general study of the burning tests summarized in FIG. 7 illustrates the relative critical nature of the internal surface areas to total corrected fuel block volume. Obviously, other block designs can be developed to fall within wanted ratios to obtain desired burning times, heat output levels, and shipping strength.

A test block having 2 slots of larger dimension but at a ratio of 0.726 was found to burn in accordance with the predetermined burn time as plotted in FIG. 7.

Figure 3:
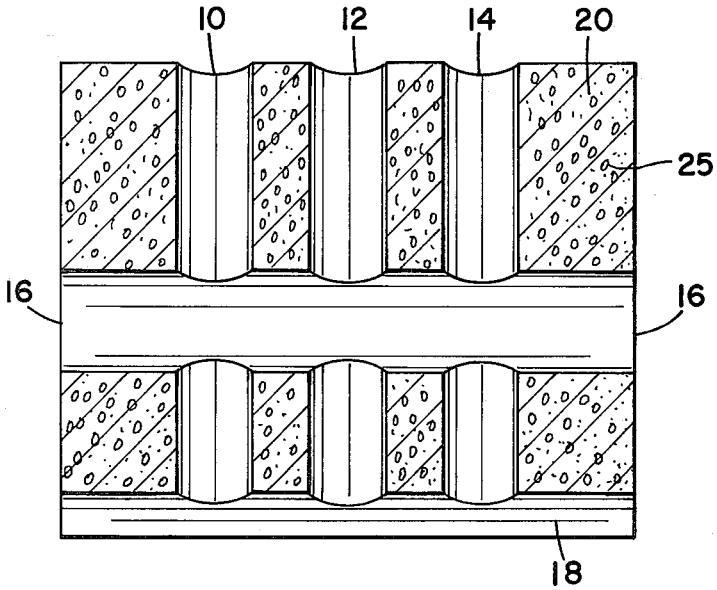
FIG. 3 is a section through 3—3 of FIG. 2.

In the cross-sectional areas 20 of FIG. 3 are shown macro size clumps 25 to represent in practice small masses of fibrous wicking material of either natural or synthetic sources of combustible material.

In the original reduction to practice shredded newsprint coarsely dispersed in macro clumps were employed. More recently straws from various agricultural products including wheat, oats, flax seed, safflower seed, etc.; bagasse, corn stalks, peat, and peat moss have all been found to be useful for capillary wicking or storage of hydrocarbon distillates. The essential wicking action appears to be associated with fibrous bundles which are lipophilic in nature and provide a capillary action concept to the sorption and storage of the volatile hydrocarbon distillates which are held in the capillary structures of these agricultural product wastes. Fibrous lignites which still retain the fibrous structure resembling later stages of the peat-to-brown coal transformation are also of economic interest. Dried macro clumps of paper pulp are useful, but aqueously dispersed micro fibrous paper pulps (pre-Fourdrinier paper pulps used in prior art for adhesive binding purposes are not functionally equivalent).

Also found useful, when available at waste material costs, are synthetic fiber macro batts or clumps of polyethylene and polypropylene fibers (T-210, a polypropylene fiber used in oil spill recovery, a product of 3M Company, is exemplary) and potentially available in forms useful for the purposes described herein.

In principle, lipophilic fibrous material which will, by capillary action, sorb and hold hydrocarbon distillates, such as Stoddard solvent when in macro clumped state of dispersion, whether natural or synthetic, appear useful from a recent survey of available materials. Estoppe, string, and rope are sometimes available at waste fiber costs and are further illustrative of lipophilic fibrous products useful for purposes herein.

The areas of block 20 represent macro clumps of ground paper (wood pulp, etc.) which aid in the extrusion step and act as a reservoir for the liquid hydrocarbon distillate fraction, part of which is present in the mixing and extruding step and part of which is sorbed by a final exposure of the completed block to the liquid hydrocarbon distillation fraction hereafter more fully described in relation to the composition of the fuel block unit.

An important aspect of the generally smokeless result obtained in the use of fuel blocks of this invention is the arcuate air passage or flue 18 of the base of the block, and the similar volume of solid composition created in the dome or top 19 of the block.

While the preferred form of the block has been illustrated in the drawings, it is within the purview of this invention to provide other geometric sections which need not be generally rectangular, but which may be curved, even to the point of being generally circular, without departing from the operative.

COMPOSITION

Having described the relative importance of the structures and illustrated the detail in the drawings, we return to the composition of the fuel or energy blocks.

Heretofore it has been general practice to produce fuel blocks by molding a coal-containing composition in a suitable mold. When this practice is followed, it is apparent from the prior art that the quality of the composition was apparently not critical as to the binder phase. While the prior art teaches the equivalence of binders such as coal tar and aqueous dispersions of paper pulp which are used variously under high pressures or high temperatures in a molding operation, so far as is presently known, the successful continuous extrusion of coal under pressures of the order of 1000#/sq. inch under normal temperatures has not been successfully demonstrated although aqueous binders have been used in molding operations.

However, water present tended to remain in the composition. A drying step requiring heat energy to drive off excess water was generally essential. In the present composition, a final heating step is not essential and the final water content of the block is of the order of 10–16% by weight. Five to 12% water added to the content of the particulate coal mixture is sufficient to allow desired extrusion quality, but not enough to interfere with the burning quality of the completed fuel block without a specific drying step.

The coal component is advantageously obtained from the waste fines from mine tailings and "gob," but obviously can be any freshly mined coal from any mine. Coal presently used is from bituminous coal mining areas. "Gob" usually contains some slate which is removed by a water washing process. Coal and coke particles between 30 and 100 mesh particle size are preferred, but not critical. A few lumps of coal derived particulates as large as 1" and a small proportion of fines below 100 mesh do not materially interfere with either manufacture or use of the fuel blocks of this invention. Moisture content is not critical, but is preferred to be not greater than about 15%, and 8 to 10% is considered normal. Excessive quantities of fines smaller than 100 mesh do interfere with the product and the method.

A second component of the fuel block is shredded, masticated, pulverized or otherwise comminuted waste cellulosic material, usually paper, and particularly newsprint of low moisture content is advantageous. Comminuted porous soft woods and wood pulp are useful if economics permit. The particulate paper serves the important function of porosity and absorption for capture of hydrocarbon liquids and a wicking function in the ultimate burning use. As indicated above, the wicking function can also be obtained from a very large variety of waste agricultural products including various cereal, straws, peat moss as well as organic polymeric fibers, particularly polypropylene. While we do not wish to be bound by theory, it is believed the lipophilic capillary nature of the fiber bundles in their macro particulate form holds captive the liquid hydrocarbon distillate in and within the interstices of the coal fragments. When the fuel block is saturated with distillate, there is provided a reservoir of heat energy which is liberated and burned at controlled release rate principally with the structure of the block. Voids within the interstices of the coal particles and the voids created by the capillary spaces in the dispersed fibrous capillary macro clumps of combustible solids are substantially saturated with a water insoluble hydrocarbon liquid which tends to saturate available interstitial space.

Proportions of the volatile liquid hydrocarbon distillation fraction of the composition is preferably not less than about 8% by weight of the completed fuel block, and if present before extrusion in excessive quantities, is forced from the cracks present in the extrusion mold and recovered for re-use. Amounts higher than 30% can be employed in the formulation of the mix before extrusion as excesses, as indicated, are recovered. A useful final range of the said liquid hydrocarbon distillation fraction in the final block is from about 10%, but not materially above 25% by weight of the volatile hydrocarbon component in the final block. For safety in storage and use, it is preferred to keep the flash point of the liquid hydrocarbon distillation fraction above about 80° F.

The volatile hydrocarbon is principally absorbed within the interstitial space of the extruded block structure to provide maximum potential heat energy within the final fuel block.

While the nature of the liquid hydrocarbon fuel reservoir formed within the interstices of the final block are not critical, some are objectionable for practical reasons. For example, #2 diesel fuel is operable within preferred limits, but in excessive quantities it interferes with the integrity of the formed block as it exits from the extruder. It is also objectionable because of its strong odor. When used, masking scents are useful in small amounts. One of the useful functions of the presence of the liquid hydrocarbon distillation fraction is that it insures against moisture absorption during storage periods in humid atmospheres and inadvertent water contact.

A further component essential to the ends of this invention are certain water soluble methyl cellulose products which are available commercially. Among those tested the hydroxy propyl methyl cellulose products in an amount above about 0.5% and not above about 2% based on the weight of the coal component were found to be better suited to the extrusion process to provide greater integrity of the extruded section and less moisture retention problem which, with some grades of methyl cellulose, could only be solved by an additional drying step. The blocks of this invention are extruded at ambient room temperatures of about 25° C. and at relatively high extrusion pressures of the order of 1000#/sq. inch.

Most satisfactory results were found when using hydroxy propyl methyl celluloses identified by the commercial designations F-50, E-4M, F-4M, and F-90M (Dow Chemical Company). Methyl celluloses identified as J-75MS, K-4M, and K-40M were less satisfactory insofar as initial block integrity after extrusion was concerned. The greater usefulness of some specific forms of methyl cellulose, as above, may be related to their tolerance of the liquid hydrocarbon distillation fraction.

Quantities of methyl cellulose above 2% by weight do not become inoperative, but above this quantity the costs increase without correlative value to the quality of the product for the use intended.

Other minor additives are of value in some instances. Small amounts of various glycols, including ethylene glycol and alcohols , illustratively isopropyl alcohol, and normal propyl have been advantageous in extrusions of some mixes. However, use of alcohols must be carefully controlled, as some qualities of methyl cellulose appear to lose adhesiveness with alcohols present and the extrusion operation fails to produce satisfactory block. Small amounts of burned lime have been useful in suppression of sulfurous by-products of combustion of coal. Other known additives in coal combustion are not to be precluded.

Having introduced the essential components of the invention and specifically described the preferred physical form of our fuel block, the following examples illustrate the best mode presently known of compounding the high energy containing fuel blocks of this invention.

EXAMPLE I

In an appropriate mixer for coarse material are incorporated 80 lbs. of coarsely ground newspaper waste and 50 lbs. of mineral spirits, a readily available liquid hydrocarbon distillation fraction. The mixer is turned on until the paper particles have absorbed a principal part of the hydrocarbon distillate liquid.

Four hundred lbs. of coal containing about 5% moisture and which passes through a 20 mesh screen, but is principally retained by a 100 mesh screen, is added to the prior mixture, along with 4¾ lbs. of dry hydroxy propyl cellulose (E-4M-Dow Chemical Company), and sufficient water to provide an extrudable mass, here about 8 gallons.

The mixer is again activated and after thorough mixing, 1 lb. of lime is included in the mix (slacked or burned). The small amount of lime (as CaO) will vary in amount depending upon the sulfur content of the coal. As observed above, lime functions to suppress noxious vapors during combustion.

The coarse plastic mixture is then extruded through an appropriate mold under pressure of about 1000 lbs./per square inch to provide an extruded block of predetermined cross-sections, as herein described, having a horizontal hole or slot laterally through the extruded form of about 1½" average diameter. This may be designed in any geometric section desired.

The extruded plastic mass is sawed into appropriate lengths (8") and a plurality of vertical holes or slots are cut downwardly from the central crown line of the convex arcuate top of the block through and preferably interconnecting within the extruded horizontal passageway and the longitudinal arcuate air passageway (extending lengthwise, or in the direction of the extrusion) through the base of the extruded sections. The formed blocks are about 8"×6" high×5" wide and weigh approximately 8 lbs.

The formed blocks are then dipped into a bath of the liquid hydrocarbon distillation fraction (dry cleaner's solvent naptha) for about a minute and are free to imbibe up to several ounces additional of the liquid hydrocarbon distillation fraction.

A bath of molten wax at about 140° F. (commercial wax-Pennzoil 10-4826 is illustrative, but not exclusively so) had been made ready and the block is dipped into the hot wax for about ten seconds. This latter coat of liquid wax solidifies upon withdrawl from the hot bath and the completed block is slipped into close-fitting paper bags or plastic film. The bagged product is then stacked for shipment.

The solid wax coating serves to seal the distillate into the block, and in ultimate use, along with the easily ignited exterior paper bag or paper wrapper further serves as igniter means for the completed high energy fuel block packaged thereby.

EXAMPLE II

Following the same general procedure as in Example I, #2 diesel fuel replaced the mineral spirits. A perfume mask was added to cover the odor. Upon extrusion, the integrity of the extruded mass was not as cohesive as desired. The amount of diesel fuel was reduced to 30# which gave improvement. The odor of the final product was generally considered objectionable to a test panel including both men and women until masked with perfume.

EXAMPLE III

Following the same procedure as in Example I, E-4M methyl cellulose was replaced with the designated commercial product F-50-LV from the same source. This was also a hydroxy propyl methyl cellulose. A satisfactory product was produced. Further drying after formation by extrusion improved the integrity of the block.

Other modifications of the foregoing preferred illustrative embodiment of Example I of the invention have been suggested in the foregoing specification and changes in the ratios and percentages of ingredients are not particularly critical, but preferred ranges have been indicated. Equivalent components to the specific ingredients disclosed can be selected within the scope of this disclosure and the following claims.

What is claimed is:

1. A combustible fuel block comprising:

(a) a major amount in excess of about 60% by weight of a water-wetted particulate hydrocarbon fuel;

(b) said fuel characterized by BTU content of in excess of about $10^4$ BTU/lb. and about $1.0\times10^6$ BTU/cu.ft.;

(c) said particulates not appreciably larger than about one inch, but principally retained on a 100 mesh screen;

(d) interstitially dispersed among said fuel particulates a minor amount of a small but effective quantity of slacked or burned lime and a relatively larger amount but less than about 25% by weight of macro clumps of capillary spaced apart combustible natural and/or synthetic fibers;

(e) said packed clumps of fibers wetted by and holding by inherent capillary voids;

(f) a quantity, but less than 25% by weight, of said particulate fuel of a fluent hydrocarbon distillate having a flash point above about 80° F.;

(g) an amount, but not essentially more than about 5% by weight, of said fuel particulates of a water soluble alkyl cellulose to provide a viscous adhesive binder phase for said water-wetted fuel particulates;

(h) said admixed mass compressed under pressures sufficient to compress and extrude said admixture into a self-supporting geometric form having:

(i) at least one air passageway longitudinally through said block;

(j) the interior surface of said air passageways having a ratio of unit area thereof to the total fuel block unit volume not greater than about 1:1 and a mean-free burning time period in excess of five hours;

(k) the exterior surfaces of said geometric form substantially overcoated with a combustible coating having a melting point above about 100° F., but less than about 225° F.

2. The fuel block of claim 1, wherein the hydrocarbon fuel is coal.

3. The fuel block of claim 1, wherein the hydrocarbon fuel is coke and coal admixture.

4. The fuel block of claim 1, wherein the macro clumps of capillary spaced apart fibers are natural fibers.

5. The fuel block of claim 1, wherein the natural fibers of claim 4 are straw selected from the group consisting of wheat, oat, flax seed, rice and barley straw.

6. The fuel block of claim 1, wherein the macro clumps of capillary spaced apart fibers are synthetic fibers.

7. The fuel block of claim 1, wherein the synthetic fibers are from the group consisting of polyethylene, polypropylene, nylon, acrylic, etc.

8. The fuel block of claim 1, wherein the macro clumps of capillary spaced apart fibers are composed of shredded paper.

9. The fuel block of claim 1, wherein the fluent hydrocarbon distillate is a coal tar distillate.

10. The fuel block of claim 1, wherein the fluent hydrocarbon distillate is a petroleum distillate.

11. The fuel block of claim 1, wherein the water soluble alkyl cellulose is a methyl cellulose.

12. The fuel block of claim 1, wherein the water soluble alkyl cellulose is a hydroxy propyl methyl cellulose.

13. The fuel block of claim 1, wherein the water soluble methyl cellulose is commercially classified as having a viscosity on the 30,000 to 60,000 centipoise range.

14. The fuel block of claim 1, wherein the interior surface area of said air passageways ratio to a total fuel block volume is from 0.9:1 to about 0.6:1 and has a normal burning time of about 6 to 8 hours.

15. The composition of claim 1, wherein the substantially overcoated combustible coating is mineral wax.

16. The method of forming a fuel block which comprises admixing a major amount of a particulate hydrocarbon fuel, the particulates of which are characterized by a continuity of size-frequency range particulates of from about one inch to about 100 mesh screeh size, said fuel particulates wetted with from at least about 5% but not more than about 16% by weight of water with a small but effective amount of lime and minor amounts of macro clumped fibrous capillary combustible organic material wetted with and containing an amount of less than about 25% by weight of said fuel particulates of a liquid hydrocarbon distillate dispersed in said capillary fibrous clumps and an amount, but not exceeding about 5% by weight, of said particulate fuel of a water soluble methyl cellulose having a viscosity grade of from about 30,000 to 60,000 centipoise and subjecting said admixture to an extrusion pressure of at least about 1,000 lbs. per square inch, extruding the admixture cohesive mass over a horizontal mandrel and through an appropriate extrusion orifice to produce a self-supporting block characterized by at least one continuous horizontal air passageway longitudinally co-extensive with said extruded section.

17. The method of claim 16, which comprises further steps of controlling the water content of the extruded block to not greater than about 16% by weight water content, immersing the block in a liquid hydrocarbon distillate and thereafter substantially coating the hydrocarbon wetted fuel block surface with a normally solid mineral wax at a temperature above the melting point of said wax.

* * * * *

UNITED STATES PATENT AND TRADEMARK OFFICE

CERTIFICATE OF CORRECTION

PATENT NO. : 4,478,601

DATED : October 23, 1984

INVENTOR(S) : Leonard Stephens and Lloyd Arnold

It is certified that error appears in the above-identified patent and that said Letters Patent are hereby corrected as shown below:

On the title page:
At [76], add --Lloyd Arnold, 504 Dunbarton Circle, Campus Commons, Sacramento, CA 95825--, as co-inventor Signed and Sealed this

*Eighteenth* Day of *June 1985*

[SEAL]

*Attest:*

DONALD J. QUIGG

*Attesting Officer*

*Acting Commissioner of Patents and Trademarks*